US006183231B1

(12) United States Patent
Van Norman

(10) Patent No.: US 6,183,231 B1
(45) Date of Patent: Feb. 6, 2001

(54) CLEAN-IN-PLACE GEAR PUMP

(75) Inventor: Drew James Van Norman, Whitewater, WI (US)

(73) Assignee: United Dominion Industries, Inc., Charlotte, NC (US)

( * ) Notice: Under 35 U.S.C. 154(b), the term of this patent shall be extended for 0 days.

(21) Appl. No.: 09/549,372

(22) Filed: Apr. 14, 2000

Related U.S. Application Data

(63) Continuation of application No. 09/164,935, filed on Oct. 1, 1998, now abandoned, which is a continuation of application No. 08/797,644, filed on Jan. 31, 1997, now abandoned.

(51) Int. Cl.[7] ..... F03C 2/00

(52) U.S. Cl. ..... 418/206.6; 418/206.7; 418/142; 418/144

(58) Field of Search ..... 418/206.6, 206.7, 418/142, 144

(56) References Cited

U.S. PATENT DOCUMENTS

| | | | | |
|---|---|---|---|---|
| 1,005,586 | | 10/1911 | Webb . | |
| 2,176,322 | | 10/1939 | Barrett . | |
| 2,933,047 | * | 4/1960 | Judkins | 418/135 |
| 2,967,487 | | 1/1961 | Nagely . | |
| 3,059,584 | | 10/1962 | Cottell . | |
| 3,096,719 | | 7/1963 | McAlvay . | |
| 3,170,408 | | 2/1965 | Hill et al. . | |
| 3,171,590 | | 3/1965 | Bentele et al. . | |
| 3,173,374 | | 3/1965 | Beimfohr . | |
| 3,427,984 | | 2/1969 | Slevin . | |
| 3,473,476 | | 10/1969 | Davidson . | |
| 3,632,240 | | 1/1972 | Dworak . | |
| 4,182,602 | * | 1/1980 | Dworak et al. | 418/132 |
| 4,293,290 | | 10/1981 | Swanson . | |
| 4,407,645 | * | 10/1983 | Haigh et al. | 418/131 |
| 4,527,966 | * | 7/1985 | Laumont | 418/132 |
| 4,606,712 | | 8/1986 | Vondra . | |
| 4,787,831 | | 11/1988 | Thomas et al. . | |
| 5,370,514 | | 12/1994 | Morita et al. . | |

FOREIGN PATENT DOCUMENTS

WO 91/00429 1/1991 (WO) .

OTHER PUBLICATIONS

Standard handbook for Mechanical Engineers, McGraw–Hill Book Company, cover pages and pp. 14–16 (copyright 1967).

A two–page article entitled "Custom Pumps," a printout from the website of the pump manufacturer. The subject matter shown in the print–out is undated, but is believed to be prior art. Also included, as part of this document, are two pages of enlarged photocopies of the TASKMASTER Pump shown at the bottom of p. 1 of the print–out materials.

A four–page Catalog No. 37 entitled Heavy Duty Gear Pumps: from Northern Division of McNally Industries, Inc. The catalog is undated but is believed to be prior art.

A six–page brochure entitled "Northern Gear Pumps." The brochure is undated but is believed to be prior art.

* cited by examiner

*Primary Examiner*—Thomas Denion
*Assistant Examiner*—Theresa Trieu
(74) *Attorney, Agent, or Firm*—Kennedy Covington Lobdell & Hickman LLP

(57) ABSTRACT

A gear pump having shafts mounted with rolling element bearings and having mechanical seals on the face of the gears provides improved "clean-in-place" ability. Preferably, washer-like seals are mounted on the face of the gears with a suitable adhesive and the cup-like seals are mounted in end housings. The end housings mate with a central housing enclosing the gears, to provide improved assembly.

21 Claims, 4 Drawing Sheets

CLEAN-IN-PLACE GEAR PUMP

CROSS-REFERENCE TO RELATED APPLICATIONS

This is a continuation application of Ser. No. 09/164,935 filed Oct. 1, 1998, abandoned, which is a continuation of Ser. No. 08/797,644 filed Jan. 31, 1997, abandoned.

BACKGROUND OF THE INVENTION

1. Field of the Invention

The present invention pertains to rotary pumps and more particularly to gear pumps.

2. Description of the Related Art

Rotary pumps have been developed for a number of different uses, ranging from fire engine apparatus to volumetric dosing of commercially important materials. Rotary pumps may be classified according to structural features of their material propelling elements. One commercially important type of rotary pump is the gear pump, in which one or more pairs of intermeshing gears propel material with their gear teeth. Examples of these types of pumps are given in U.S. Pat. Nos. 1,005,586; 2,176,322; 3,096,719; 3,427,984; 2,967,487, and in a modified, related form in U.S. Pat. Nos. 3,170,408; 3,171,590; and 4,787,831.

Pumps of the above-described type can be employed with a single shaft, with the gear teeth in contact with an appropriately shaped casing, to trap the material to be transported between the gear and the casing. Pumps may also employ a pair of intermeshing gears designed to propel materials between intermeshed teeth. Pumps may be distinguished by the configuration of the gears and may, for example, utilize spur gears as well as screw-type or helical gears.

Regardless of the types of gears employed, design challenges have arisen to minimize leakage of material flowing through the pumps while providing adequate rotational support for the shafts on which the gears are mounted. These and other improvements in gear pumps are constantly being sought. For example, it is desirable in some applications to be able to clean a pump "in place" without requiring the pump to be removed and disassembled at a remote cleaning location.

SUMMARY OF THE INVENTION

It is an object of the present invention to provide a gear pump having a pair of intermeshed gears which propel material through the pump.

Another object of the present invention is to provide a gear pump which can be cleaned "in place" to a degree sufficient for commercially important applications.

A further object of the present invention is to provide a gear pump of the above-described type which can be simply and economically manufactured from a minimum of inexpensive parts.

These and other objects of the present invention, which will become apparent from studying the appended description and drawings, are provided in a gear pump having a housing means for defining an internal cavity with a flow entrance and a flow exit communicating with the internal cavity, a first shaft, a first pump gear mounted on the first shaft, a first gear seal carried by the first shaft, a second shaft, a second pump gear mounted on the second shaft, a second gear seal carried by the second shaft, rolling element bearings carried by the housing means so as to be spaced from the first and the second gear seals and so as to mount the first and the second shafts to the housing in intermeshing rotation with one another, first and second housing seals carried by the housing means for mating engagement with the first and the second gear seals, respectively, the first and the second housing seals spaced from the first and the second shafts, respectively.

DETAILED DESCRIPTION OF THE PREFERRED EMBODIMENT

Figure 1:
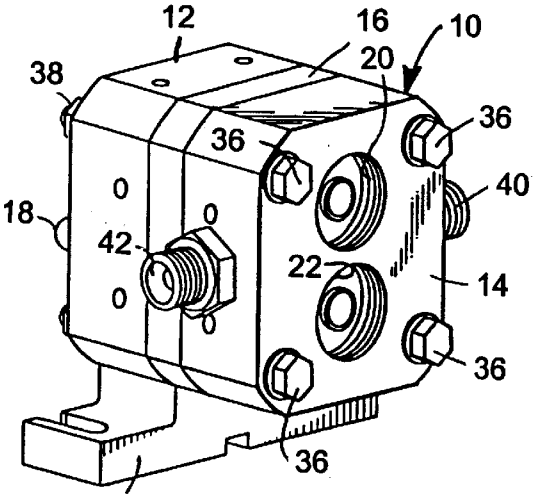
FIG. 1 is a perspective view of a pump according to principles of the present invention.
Figure 2:
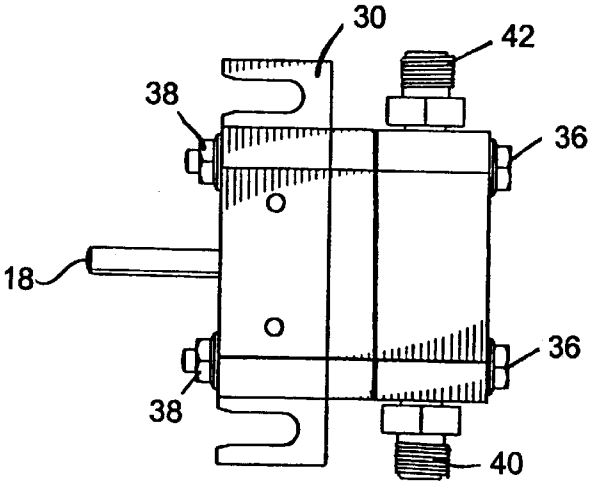
FIG. 2 is a bottom plan view thereof.
Figure 4:
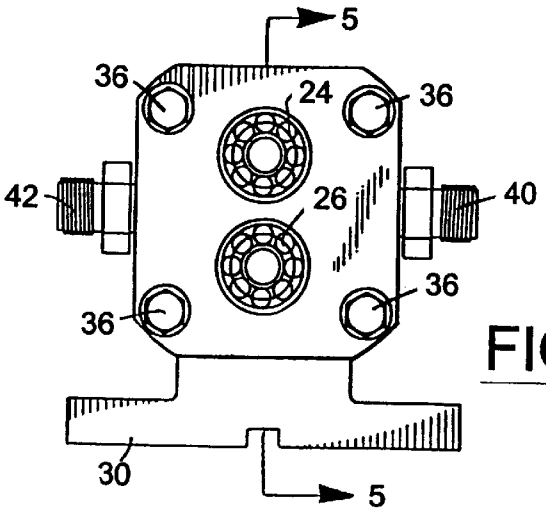
FIG. 4 is a rear elevational view thereof.
Figure 3:
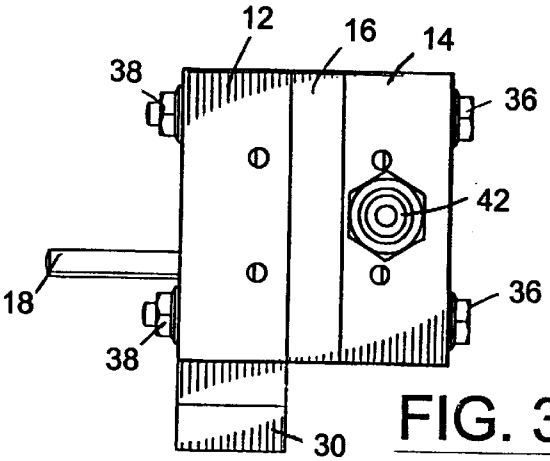
FIG. 3 is a side elevational view thereof.
Figure 6:
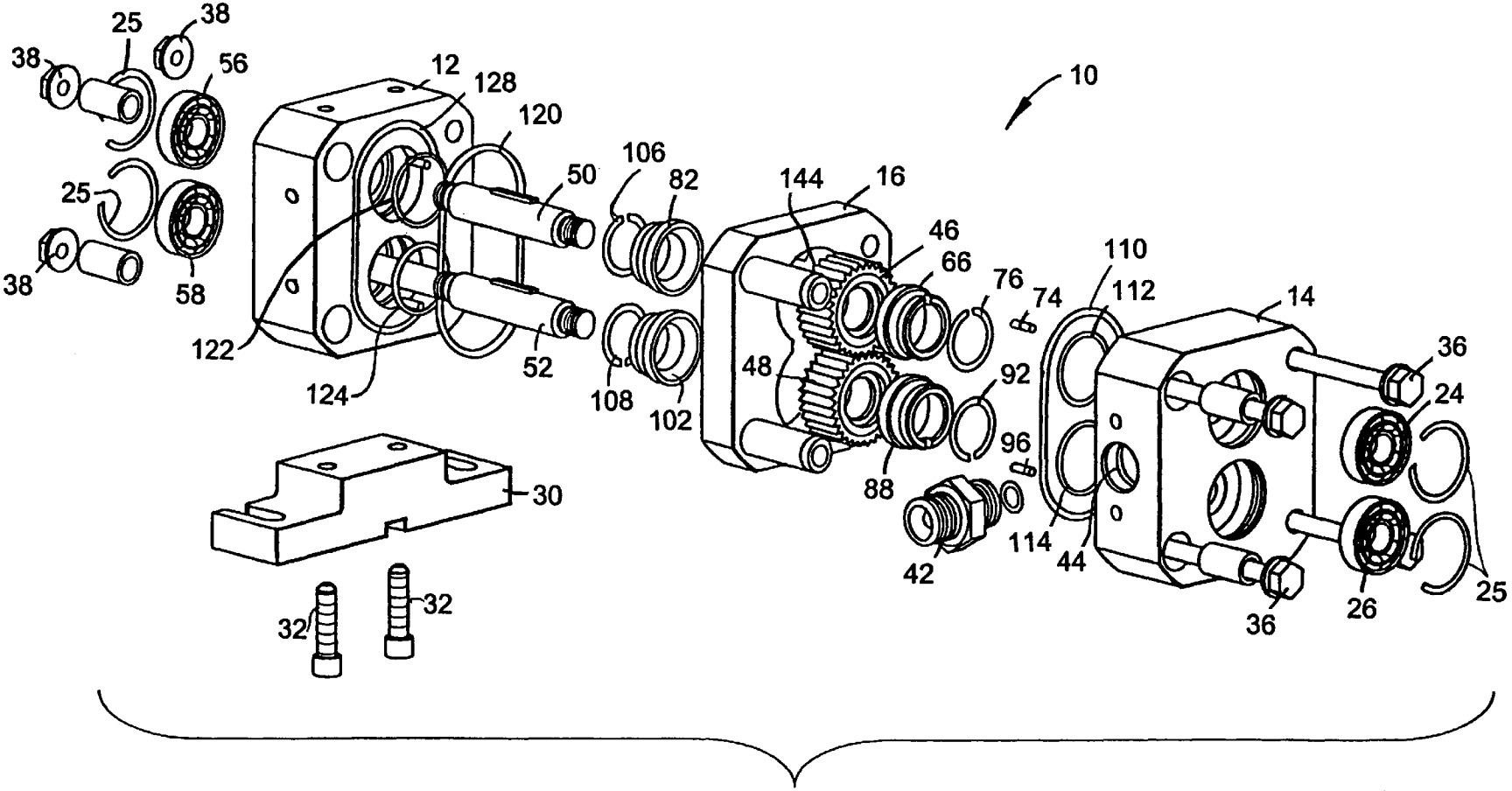
FIG. 6 is an exploded perspective view thereof.

Referring now to the figures, a gear pump generally indicated at 10 is made of three housing members, including end housings 12,14 and a center housing 16. A drive spindle 18, visible in FIGS. 1–3, protrudes from the forward end of the pump, passing through end housing 12. The rear end of the pump, visible in FIGS. 1 and 4, includes recesses 20,22 for receiving rolling bearings, preferably in the form of ball bearing races 24,26 (omitted in FIG. 1 but visible in FIG. 4). A mounting bracket 30 extends from end housing 12 and, as indicated in FIG. 6, is secured thereto with threaded fasteners 32. A plurality of bolts 36 pass through housings 12–16 to hold the housings in compression with nut fasteners 38.

A pair of threaded fittings 40,42 are received in threaded openings formed in end housing 14. One threaded opening, designated by the numeral 44, is visible in FIGS. 6 and 7. Depending upon the direction of rotation of the spindle 18, either fitting 40,42 can serve as the flow input fitting, conducting material to the interior of end housing 14.

Figure 5:
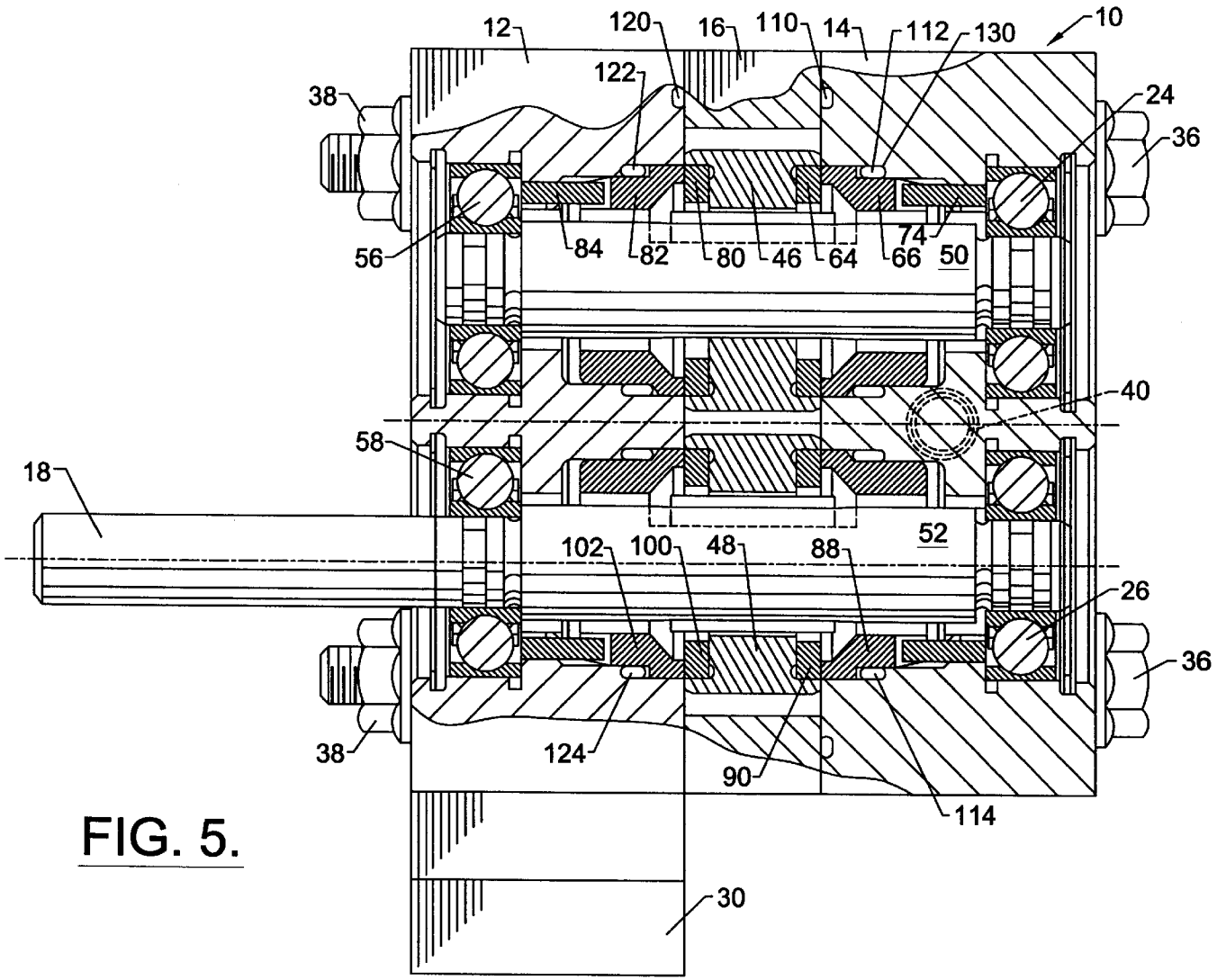
FIG. 5 is a cross-sectional view taken along the line 5—5 of FIG. 4.
Figure 7:
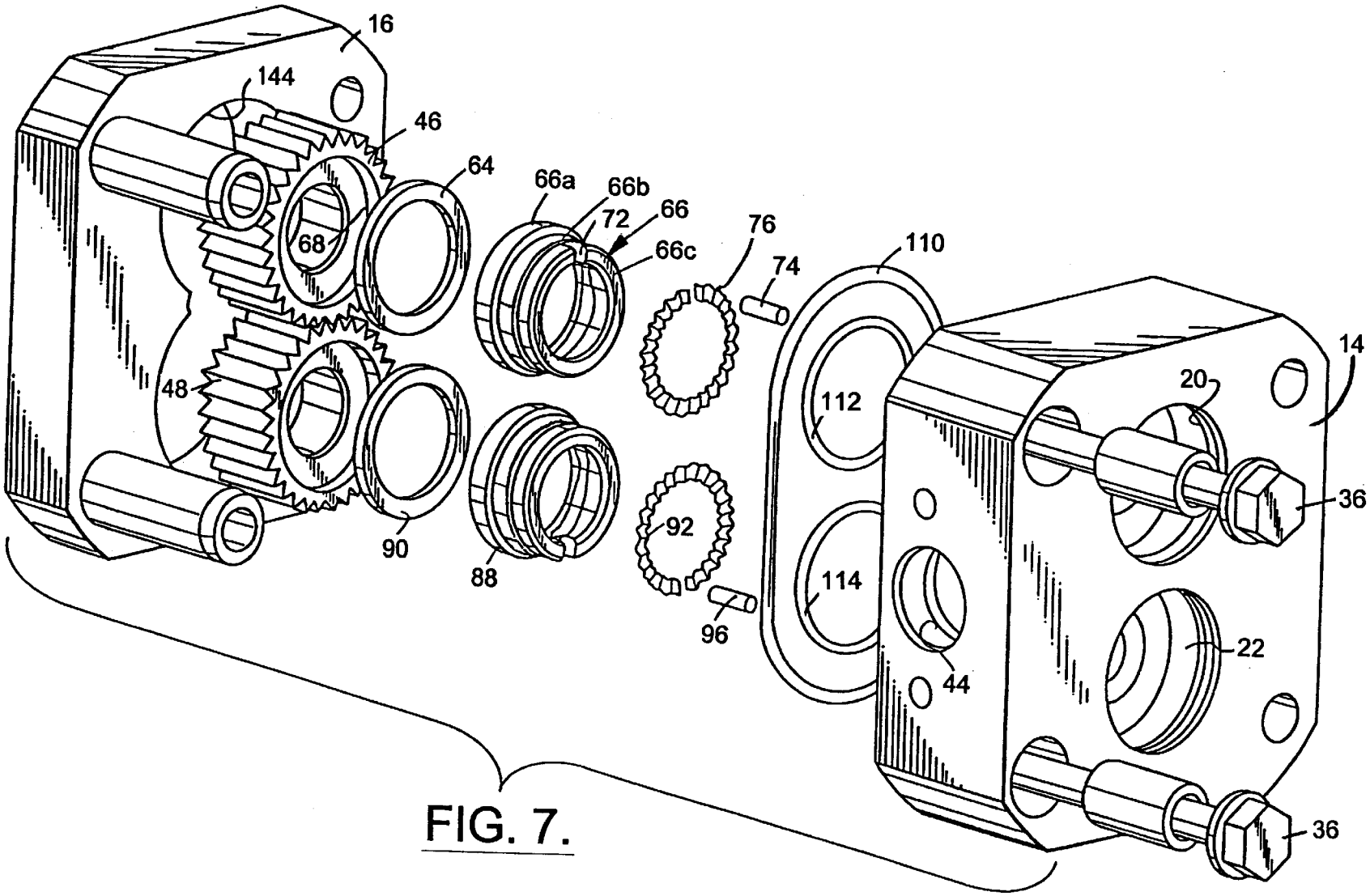
FIG. 7 is a fragmentary view of FIG. 6, taken on an enlarged scale.

Turning now to FIGS. 5–7, gears 46,48 are mounted on shafts 50,52 so as to be positioned within center housing 16 (see FIG. 5). The ball bearing races 24,26 support the rearward ends of shafts 50,52, while ball bearing races 56,58 support the forward ends of shafts 50,52. As can be seen in FIG. 5, spindle 18 extends from the bottom shaft 52 and is preferable integrally formed therewith.

Referring again to FIGS. 6 and 7, it can be seen that seal sets are provided on each side of the gears 46,48. For example, as shown in FIG. 7, a first seal set associated with one side of upward gear 46 includes a ring-like gear seal and a cup-like housing seal 66. Preferably, the gear seal 64 is received in a recess 68 formed in one face of gear 46. Gear seal 64 is preferably secured to the gear face with a suitable adhesive so as to rotate with gear 46. The cup-like housing seal 66 is herein described as having three stepped portions, a ring-like face portion 66*a*, a central frustoconical portion 66*b* and an outer reduced diameter ring-like end portion 66*c*.

A notch 72 formed in end portion 66*c* receives a pin 74 pressed into housing 14. As can be seen in the upper right-hand portion of FIG. 5, pin 74 is received in housing seal 66 so as to prevent its rotation about the axis of shaft 50. A spring member 76 engages the exposed face of housing seal portion 66*c*. As bolts 36 are tightened to draw the housing portions together, spring 76 is compressed between housing 14 and housing seal 66. Spring 76 is of a conventional "crinkle-like" construction so as to store bias energy when compressed. With the pump assembled, energy from spring 76 presses gear seal 64 and housing seal 66 together maintaining the seal set in compression with one another as the pump is operated.

Referring to FIG. 5, a seal set is located at the opposed (left-hand) face of gear 46. Preferably, gear seal 80 and housing seal 82 are similar to the gear seal member 64,66 described above. A pin 84 prevents rotation of housing seal 82 while gear seal 80 is secured by adhesive within a recess formed in the face of gear 46. Thus, in the preferred embodiment, portions on either side of a central plane drawn through upper gear 46 are mirror images of one another.

In the preferred embodiment, additional seal sets, preferably identical to those described above, are provided on either side of lower gear 48. Referring again to FIG. 7, a housing seal 88 and a ring-like gear seal 90 are provided to one side of gear 48. An annular spring 92 maintains the seals 88,90 in engagement with one another during operation of the pump, and a pin 96 received in housing 14 prevents rotation of housing seal 88. As with the other seal sets described herein, it is preferred that the ring-like gear seal 90 is secured in a recess in gear 48 using a suitable adhesive. A seal set, including a ring-like gear seal 100 and a cup-shaped housing seal 102 is provided at the opposed face of lower gear 48, as can be seen in FIG. 5. Annular spring members 106,108 maintain the seals associated with upper and lower shafts 50,52 in engagement with one another (see FIG. 6).

Referring again to FIG. 6, gaskets 110,112,114 are located between housings 14,16, and gasket members 120,122,124 are located between housing members 12, 16. As can be seen at the left-hand end of FIG. 6, a recess 128 is formed in end housing 12 to receive outer gasket 120. Preferably, annular grooves are formed in the same face of end housing 12 to receive circular gaskets 122,124, these latter recesses not being shown in FIG. 6 for purposes of clarity. Although not visible in the figures, similar recesses are formed in the inner face of end housing 14, so as to receive outer gasket 110. The gaskets 110,120 are visible in FIG. 5, where the opposed faces of housing portions 12–16 engage one another. In inner, annular gaskets are received about the mid portions of stepped housing seals, as can also be seen in FIG. 5. For example, gasket 112 is disposed about the stepped portion of housing seal 66, being held captive between the enlarged end of housing seal 66 and an internal step portion 130 formed in end housing 14.

It is generally preferred that the gaskets are received in recesses formed in the end housings 12,14. This results in economy of assembly, as the center housing can be more economically formed with generally flat opposing major faces. As the bolts 36 are drawn tight by advancing nut fasteners 38, the gaskets 110, 120 are compressed, sealing the housings together in a fluid-tight construction.

As can be seen in the preferred embodiment shown in FIG. 5, the gears 46,48 preferably have the same general width as that of the center housing 16, it being preferred that the ring-like gear seals are mounted in the gears with a flush fit. As will be appreciated by those skilled in the art, a variety of gear tooth arrangements can be employed in the pump of the present invention. For example, the teeth can be formed in different configurations (e.g. straight spur-gear or helical impeller), but, in any event, as is typical with internal gear pump constructions, a substantial number of teeth are in contact with the outer housing. With refer-ence to FIG. 5, the outer peripheral portions of the gears extend beyond the cup-like housing seals with their major side faces contacting, or at least in close proximity to, the inner opposed major faces of end housings 12,14.

In FIG. 5, the teeth of the gears are shown solid whereas the remainder of the gears are shown in cross-hatching. However, it should be understood that the teeth of the gears are in contact with, or at least immediately adjacent, the internal edge of center housing 16, formed by the bi-lobed opening 144 (see FIG. 7). With reference to FIGS. 5 and 6, material to be pumped enters one of the ports 40 or 44 and travels toward the center housing 16.

Material also passes through the recesses receiving the circular gaskets 112,114,122,124. These recesses are formed between the cup-like housing seals and the stepped portions of the end housings, as can be seen, for example, in FIG. 5. Thus, as inlet pressure is increased, the pressure of the cup-like housing seals against the ring-like gear seals is augmented by the inlet material pressure. As explained above, the cup-shaped housing seals have a stepped cross-section, with an enlarged diameter inner end and a reduced diameter outer end joined together by an intermediate frusto-conical portion.

As will now be appreciated, the end housings can accommodate generally cylindrical housing seals with a minimum modification to the members shown and described above. While cylindrical housing seals are more economical to construct, it is generally preferred that the housing seals have a stepped diameter so as to provide a gasket contacting, axially facing surface, as well as an option for additional conformance with the end housings. With spring loading to be described herein, the seals function like pistons which move in an axial direction to provide internal alignment during assembly and to maintain alignment over the life of the pump. Further, if desired, sufficient play can be provided in a direction normal to the shaft to provide an automatic off-axis conformance, which is enhanced by the stepped cylinder shape of the housing seals.

With reference to FIG. 6, the end housings of pump 10 are assembled first, with the housing seals and biased springs being fitted in the stepped annular recesses formed to extend from the inner face of the end housings. In preparation for mating of the housing seals, anti-rotation pins 74,96 are inserted in end housing 14 from the inner face thereof. The ball bearing races 24,26 are inserted in end housing 14 and retainer rings 25 are installed in housing 14, outward of the ball bearing races. As can be seen in FIGS. 6 and 7, for example, the bias springs 76,92 are broken by a gap through which the anti-rotation pins 74,96 pass, thus preventing rotation of the bias springs.

As can be seen in FIG. 5, the anti-rotation pins are sufficiently seated in the housing seals, to allow the housing seals an amount of "end play". The gaskets 110–114 are then inserted in the recesses formed in the end housing and the central housing 16 and end housing are mated together. The shafts 50,52 and gears 46, 48 are then inserted, along with the remaining end housing and its related components. Bolts 36 are then passed through the housings and compressive force on the stacked housings is then applied with threaded fasteners 38 to form a pressure-tight assembly of the housings, to seat the shafts in their respective ball bearing races and to seat the bias springs, housing seals and gear seals in desired relationship with one another. In the preferred embodiment, mounting base 30 is attached to end housing 12 with threaded fasteners 32.

Several economies of manufacture were pointed out above. For example, it is important that the cooperating seal members be accurately positioned with respect to one another and with respect to the rotating gears. With the arrangement of the present invention, the gear seals are simply formed with a washer-like configuration, the critical dimension of which is the outer diameter to complement the annular recesses formed in the major faces of the gears. As mentioned, it is preferred that the gear seals be secured to the gears with a suitable adhesive. This allows the gear seals to be machined for planarity with the opposed outer faces of the gears. Thus, precision control is provided at a minimum cost.

The cup-like housing seals, as mentioned, are inserted in cup-shaped stepped inner bores formed in the end housings, with the housings providing the desired orientation of the housing seals. If desired, the end housing assemblies can be constructed such that the housing seals and inner face of the end housings are ground in a common operation to attain a desirable common planarity. Further, the modular construction of the pump allows ready modification using conventional machining operations.

As can be seen in FIG. 5, both the gear seal and housing seal are constrained against radial outward movement, since these members are received within recesses or inner bores formed in these relatively massive components. Thus, the inner engaging seals are afforded greater stability under load. Further, the load forces on the bearings are confined at a well defined point, remote from, i.e., spaced away from the shafts 50,52, thus making it easier to maintain alignment under loaded conditions.

It will be seen in FIG. 5, that the point of sealing contact between the gear and housing seals is spaced away from both the shafts 50, 52 and the bearings supporting those shafts, further contributing to the long life of the pump internal members, while confining material flow to portions of the pump which are more easily cleaned. The improved configuration of material passageways through the pump has led to the immediate commercial acceptance of pumps constructed according to the principles of the present invention. In addition, by employing rolling bearing means (e.g. ball bearing or needle bearing means or the like) relatively high pump speeds can be readily obtained without sacrificing longevity or increased internal leakage within the pump. In one commercially important application of pumps constructed according to the principles of the present invention, the pumps are operated at higher speeds during cleaning, further adding to the ability of the pumps to be cleaned "in place" without requiring pump disassembly or relocation to a remote cleansing site.

As can be seen in FIG. 5, the cup-like housing seals are supported on the outside of the seals, rather than the inside. As can be seen in FIG. 5, the inner bores of the housing seals are spaced from the shafts 50,52. Thus, any "wobble" introduced in the housing seal due to a non concentric alignment of its fitting with the support shaft is eliminated.

As mentioned, ball bearing races are provided in the preferred embodiment. However, other types of rolling element bearings (e.g. needle bearings or roller bearings) can also be employed to eliminate sliding contact with the shaft, so as to allow the gear to be fixed to the shaft and to also eliminate the need for employing the material as lubricant for internal parts within the pump. These features allow greater stability and higher operating speeds. Higher speeds are important, not only for increased through put, but also to reduce down time by speeding the cleaning of the pump and downstream components. Further, mechanical seals carried on each face of the gears, excludes material from the inner face between the shaft and gear, thus eliminating crevices which have been found difficult to adequately clean.

The ability to provide a pump which can be automatically cleaned in place with minimum down time required provides a number of operating advantages. For example, certain materials, such as paints and other coatings, have inherent properties which result in a build-up or other non-uniform flow condition within a pump, even if customary care is taken to maintain the pump system. For these difficult materials, cleaning can be scheduled on a regular basis, as often as is necessary to maintain the desired flow performance. Further, rapid cleaning of a pump internal members provides advantages in manufacturing environments requiring change over from one material to another. For example, in automated painting operations it is desirable to regularly change from one color to another, or to change from a base coat material to a top coat material, for example.

It is important in such instances, that the previous material be thoroughly cleaned from the pump, before utilizing the pump to produce a finished product. Reduced down time with pumps according to the principles of the present invention is possible because of the increased pump speed but also because the internal passageways within the pump are inherently easier to clean.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A gear pump comprising:

a housing means for defining an internal cavity with a flow entrance and a flow exit communicating with the internal cavity;

a first shaft, having a central portion and an outer surface;

a first pump gear mounted on the central portion of the first shaft;

a pair of first gear seals carried by the first pump gear and spaced from the outer surface of the first shaft with voids between the first gear seals and the outer surface of the first shaft;

a second shaft, having a central portion and an outer surface;

a second pump gear mounted on the central portion of the second shaft;

a second pair of gear seals carried by the second pump gear and spaced from the outer surface of the second shaft with voids between the second gear seals and the outer surface of the second shaft;

rolling element bearings carried by the housing means so as to be spaced from the first and the second gear seals and so as to mount the first and the second shafts to the housing in intermeshing rotation with one another;

said first and second shafts each carrying a pair of springs, disposed on either side of said first and said second pump gears, respectively, to bias said pump gears in alignment with one another at a desired axial position with respect to said housing means;

first and second housing seals carried by the housing means for mating engagement with the first and the second gear seals, respectively with the first and second housing seals located axially outwardly of the first and second gear seals, respectively; and the first and the second housing seals spaced from the first and the second shafts, respectively.

2. The gear pump of claim 1 wherein the first and the second gear seals are carried on major faces of the first and the second pump gears, respectively.

3. The gear pump of claim 1 wherein the first and the second gear seals have ring configurations.

4. The gear pump of claim 3 wherein the first and the second gears define recesses in their major faces and the first and the second gear seals are received in the recesses.

5. The gear pump of claim 2 wherein the housing means comprises a central housing between two end housings, with the end housings defining stepped internal bores for receiving respective housing seals.

6. The gear pump of claim 5 wherein the first and the second housing seals have a cup configuration with a first diameter end portion and a second smaller diameter end portion.

7. The gear pump of claim 6 wherein the first and the second housing seals have a generally frusto-conical intermediate portion between the first and the second end portions.

8. The gear pump of claim 1 wherein the housing means comprises a central housing between two end housings.

9. The gear pump of claim 8 wherein the rolling element bearings are rotatably mounted in the two end housings.

10. The gear pump of claim 9 wherein the rolling element bearings comprise ball bearing means.

11. The gear pump of claim 8 wherein the first and the second pump gears are located in the central housing.

12. The gear pump of claim 11 wherein the central housing defines a bi-lobed bore for receiving the first and the second gears.

13. The gear pump of claim 11 further comprising gasket means between the central housing and the end housings.

14. The gear pump of claim 13 further comprising fastening means passing through the first and the second end housings and the central housing.

15. The gear pump of claim 11 wherein the housing seals define recesses and the gear pump further comprises pins protruding from the end housing means so as to be received in the housing seal recesses to prevent rotation of the housing seals.

16. The gear pump of claim 15 further comprising gasket means between the housing seals and the end housings.

17. A gear pump comprising:

a housing means for defining an internal cavity with a flow entrance and a flow exit communicating with the internal cavity;

a first shaft;

a first pump gear mounted on the first shaft;

a first gear seal carried by the first pump gear;

a second shaft;

a second pump gear mounted on the second shaft;

a second gear seal carried by the second pump gear;

rolling element bearings carried by the housing means so as to be spaced from the first and the second gear seals and so as to mount the first and the second shafts to the housing in intermeshing rotation with one another;

first and second housing seals carried by the housing means for mating engagement with the first and the second gear seals, respectively;

the first and the second housing seals spaced from the first and the second shafts, respectively;

the housing means including a central housing between two end housings, with the end housings defining stepped internal bores for receiving respective housing seals, and with the rolling element bearings rotatably mounted in the two end housings; and the first and the second housing seals have a cup configuration with a first diameter end portion and a second smaller diameter end portion.

18. The gear pump of claim 17 wherein the first and the second gear seals are carried on major faces of the first and the second pump gears, respectively.

19. The gear pump of claim 18 wherein the first and the second gear seals have ring configurations.

20. The gear pump of claim 19 wherein the first and the second gears define recesses in their major faces and the first and the second gear seals are received in the recesses.

21. The gear pump of claim 17 wherein the first and the second pump gears are located in the central housing.

* * * * *